United States Patent [19]

Long

[11] 4,241,636

[45] Dec. 30, 1980

[54] ELECTRONIC MUSICAL INSTRUMENT

[76] Inventor: Christopher Long, Rte. 6, Box 856, Tallahassee, Fla. 32301

[21] Appl. No.: 973,855

[22] Filed: Dec. 28, 1978

[51] Int. Cl.[3] ..... G10H 1/18; G10H 1/42

[52] U.S. Cl. ..... 84/1.01; 84/1.03; 84/DIG. 7; 84/DIG. 12

[58] Field of Search ..... 84/1.01, 1.03, 1.1, 84/1.22, 1.23, 1.27, 423, DIG. 7, DIG. 11, DIG. 12, DIG. 22, DIG. 23, 423 R, 423 B

[56] References Cited

U.S. PATENT DOCUMENTS

| | | | |
|---|---|---|---|
| 2,873,637 | 2/1959 | Herold | 84/DIG. 7 |
| 3,986,422 | 10/1976 | Coles | 84/1.01 |
| 3,992,973 | 11/1976 | Howell | 84/DIG. 11 |

*Primary Examiner*—S. J. Witkowski

*Attorney, Agent, or Firm*—Hume, Clement, Brinks, Willian & Olds, Ltd.

[57] ABSTRACT

An electronic musical instrument which has any desired compass of musical sounds and which produces justly intoned pitches based on any desired pitch or note and which is capable of changing at will during performance the basic pitch or the "do" (of do, re, me, etc.). The instrument has a single master oscillator having means for changing the pulse interval at will and during performance. The output of the oscillator is fed to a system of counters and gates, the output of which is a number of pulse trains which are related in frequency by ratios of small integers and which ratios are maintained unchanged regardless of the frequencies of the various outputs. The instrument includes a keycylinderin place of the usual keyboard and it has on its surface several helices of conductive contacts. The keycylinder is of a size to be accommodated in the hands of the operator with the contacts readily accessible to the operator's fingers and has the capability, by rotation or bodily movement of varying the intervals of the oscillator and thereby the pitch or frequency of the various outputs while, at the same time, maintaining the interval ratios established by the counters and gates. The keycylinder further has those contacts which produce consonant sounds disposed in close relation to each other so that up to four contacts may be jointly touched by a single finger or the thumb of the operator at one time.

14 Claims, 4 Drawing Figures

ELECTRONIC MUSICAL INSTRUMENT

BACKGROUND AND SUMMARY OF THE INVENTION

This invention relates to an improved electronic musical instrument which has any desired compass of musical sounds and which produces justly intoned pitches based on any desired pitch or note and which is so constructed that the basic pitch or "do" (of do, re, me, etc.) can be changed at will during performance.

One aspect of this invention involves the application of technology to solve a musical problem that occupied the interest of Pythagoras, Bach, Helmholtz, and many others. The problem is this: when an instrument that produces fixed pitches is tuned so that the intervals in one key signature are pure (naturally intoned or beatless), the instrument is out of tune when played in other key signatures. Such instruments are usually tuned to equal temperament in which none of the intervals (except the octaves) is pure or beatless. In this invention all the pitches are tuned at once so that the intervals remain pure when the key signature is changed.

It is well known that all fixed pitch musical instruments are capable of producing a justly intoned scale in only one key signature and that accordingly to achieve the ability to produce scales of different key signatures, it is presently the practice to deliberately detune or temper the intervals so that the instrument is equally out of tune in all key signatures. This is known as equal temperament.

Also it is well known to serious musicians that the ratio of frequences of any two preselected notes which comprise a given musical interval is independent of the notes that are chosen or in other words that the key frequency ratio remains unchanged when the interval is transposed into any or all other key signatures.

In view of the fact that Pythagorus, centuries ago showed that it was mathematically impossible to justly tune a fixed pitch instrument so that it would be justly tuned in all key signatures, efforts to deal with this problem, for the most part, have been directed to different systems for tempering the scale. All of these have been compromises. More recently, since the advent of electronics, an instrument has been developed which can be programmed by moving numerous switches with the result that it can produce justly intoned pitches in certain key signatures, but in only one key for any given disposition of the programmed switches.

Accordingly it is an object of this invention to provide a new and improved polyphonic musical instrument which is capable of producing justly intoned pitches, scales, or chords and at the same time is capable of changing to any key signature or any intermediate tonality at will during performance of the instrument.

It is a further object of this invention to provide an instrument of the type referred to, the keys of which have individual soft-loud characteristics like a piano and unlike a harpsichord or organ. This is accomplished by providing electrical digital contact points which are touched by the fingers of the performer and by including the body of the performer as a part of the electric circuit whereby the light or firm pressure exerted by the performer, when touching each particular contact point, produces a correspondingly soft or loud sound. Thus, during performance, the fingers of the performer and the digital contact points respectively function as a combined switch and variable resistance under the direct control of the performer. Also as the performer's body is connected into the circuit by a second contact, when the second contact is established between a bare foot or other bare portion of the performer's body capable of exerting variable pressure on such contact during the performance, a further control is made available. This latter contact can be employed to reduce or increase the loudness of the instrument as a whole and thus provide an additional control over and above the controlled variations produced by the fingers on the contact points, respectively.

With this construction, it is the contact points collectively that constitute the part of the instrument that is manipulated by the performer when performing on the instrument and therefore it is the collection of contact points that takes the place of the keyboard or the like employed on pianos and organs.

It is a further object of this invention to provide a novel and highly useful construction for the contact point assembly, which is preferably in the form of a cylinder or the like, of a size to be readily accommodated in the hands of the performer and having a multiplicity of separate contact points disposed with respect to each other on the surface of the cylinder so that they readily may be touched by the fingers of the performer for sounding the desired notes or chords.

It is a further object of this invention to so construct and mount the cylinder that at the same time the notes or chords are being sounded by the performer, the cylinder is capable of being manually moved bodily, as by rotation on its own axis, or otherwise, to change the key signature to any other selected key signature without interrupting the performance. Such rotation readily can be affected by the performer holding the cylinder in his hands while fingers are disposed in performing position with respect to the contact points.

It is a further object of this invention to align the contact points on helices on the surface of the cylinder, in a manner hereinafter more fully described and to so space the contact points that the performer may contact one, two, three, or four contact points at a time with one finger or a thumb. Furthermore, the contact points are oriented with respect to each other so that those producing consonant sounds are disposed in close association with each other. This orientation is quite different from the orientation of keys producing consonant sounds now characteristic of piano or organ keyboards.

Another object of this invention is to provide an instrument that can produce a drum-like rhythm or a composite of two or more rhythms all under the direct and instantaneous control of the performer with the capability of changing the performed rhythm or subdivisions thereof at will.

These and other objects are contemplated for this invention as will become apparent to one skilled in this art from the accompanying drawings as the following description proceeds.

The following description and the accompanying drawings disclose only one form of this invention and are given here by way of illustration and not by way of limitation and are not to be construed as limiting the invention in any respect not required by the accompanying claims. Other forms are contemplated for this invention as will readily appear to one skilled in this art and familiar with available equivalents in the electronic field.

DETAILED DESCRIPTION OF THE DRAWING OF ONE SPECIFIC EMBODIMENT OF THIS INVENTION

Figure 1:
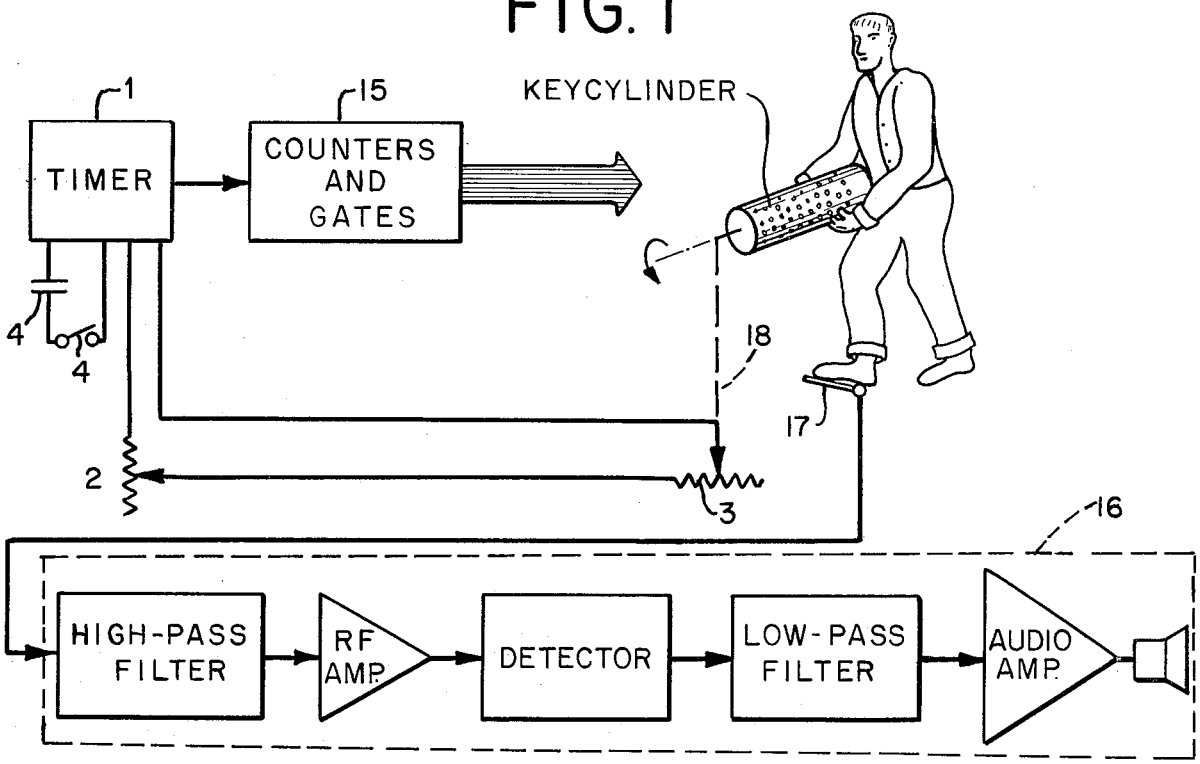
FIG. 1 is a combined block diagram and sketch illustrating the essential parts of this invention. The performer, for purposes of illustration, is shown smaller in proportion to the keycylinder. In use the keycylinder is adapted to be embraced by the two hands of the performer so that the performer can touch the conductive contacts as well as rotate the keycylinder in the manner described herein. Also the foot plate is intended to illustrate an electrical contact with the bare skin of the performer's foot.

Referring to the drawings, it will be noted that a single oscillator or timer 1 is provided which puts out a continuous stream of pulses. The length of time between the onset of one pulse and the onset of the next pulse (time between pulses or t), can be changed by three separate means which are provided. A potentiometer 2, which has a knob, can be turned or the whole keycylinder can be rotated about its axis to vary the potentiometer 3. In the illustrations shown in FIGS. 1 and 2 the dashed lines 18 extending between the keycylinder and the potentiometer 3 represent a mechanical connecting means which is capable of imparting movement to the pentiometer to adjust the same when the keycylinder is turned or otherwise moved by the operator. Either of these actions cause a continuous change in t. A switch can also be used to connect, when closed, a capacitor 14 which greatly increases t. This switch 4 is closed when this invention is employed to produce rhythms.

As shown in FIG. 1, the pulse stream is connected to a system of counters and gates identified collectively as 15. As shown specifically in FIG. 2 the counters and gates comprise three chains of electronic counters 5, 6 and 7. To explain the mathematical formula involved here and set forth below, it should be noted from FIG. 2 that each counter of the chain of electronic counters, designated 5, is a divide-by-two counter and each functions to change its output state whenever a pulse arrives at its input. Therefore the length of time between output pulses is twice the length of time between input pulses. The length of time $P_l$ between output pulses of the $l^{th}$ member of the chain, is the $l^{th}$ power of 2 times t or $P_l = 2^{l}$ t. Each divided-by-two counter output is a square wave, but the outputs are combined by a chain of AND-gates 8, to cause all the pulses to have the same duration while their periods are different. Similarly, the length of time between pulses in the $k^{th}$ output of the divide-by-three counters 6, $Q_k$, is the $k^{th}$ power of three times k or $Q_k = 3^k$ t. And, finally, for the divide-by-five counters 7, we have $R_h = 5^h$ t. Each chain of counters has a chain of AND-gates 8, 9 and 10 to keep the durations of the pulses equal.

The pulse streams from the divide-by-three counter 6, and the divide-by-five counter 7 are combined in an array 11 of AND-gates and the outputs of these gates are combined with the outputs of the divide-by-two counters in another array 12 of AND-gates. The outputs of the array 12 are connected to electrically conductive contact points disposed as a helix on the surface of the keycylinder. Each contact point gives a pulse of the same duration but the length of time $T_{hkl}$ between pulses is $T_{hkl} = 5^h 3^k 2^l$ t.

The ratio of periods is just the inverse of the ratio of frequencies, so by touching two contacts on the cylinder at the same time, musical intervals can be produced whose frequency ratio is the ratio of two small whole numbers. The frequency ratio is independent of t so that the pitches elicited by touching two contact points can be changed while they remain at a fixed musical interval or frequency ratio.

Some of the intervals available are members of a naturally or justly intoned scale. Table 1 gives some of the frequency ratios.

TABLE 1

| Musical Interval | Frequency Ratio |
|---|---|
| Octave | 2/1 |
| Seventh | 15/8 |
| Sixth | 5/3 |
| Fifth | 3/2 |
| Fourth | 4/3 |
| Third | 5/4 |
| Second | 9/8 |
| Unison | 1/1 |

Impure scales and other scales are also present on the cylinder, and they all change pitch on the same ratio of frequencies when the cylinder is rotated.

The wide arrow-shaped area shown in FIG. 1 of the drawing enclosing a plurality of horizontal links which extends to the right from the system of counters and gates, identified collectively as 15, and points toward the keycylinder, represents a multiplicity of conductors, each connecting one of the pulse trains of said number of pulse trains to one of the contacts of said multiplicity of contacts of said keycylinder.

When the player touches some contact points on the cylinder, a tiny electric current flows over his skin to an electrode which is connected to the pick-up circuit 16 shown in FIG. 1. This curcuit picks up and amplifies the pulses because their Fourier spectrum is rich in frequencies to which the circuit is sensitive. When the pulses have a frequency in the audio frequency range, a musical tone is heard in the loudspeaker. Its quality or timbre can be adjusted, using the tone controls on the audio amplifier of the circuit. The loudness of each pitch depends on the pressure and area of finger surface touching the contact point. The overall loudness is controlled by the pressure on the body electrode 17 which can be touched with a bare foot or other portion of the body as shown in FIG. 1.

As best illustrated in FIG. 1 it will be noted that the pick-up circuit 16 comprises a high-pass filter, a radio frequency amplifier, a detector, a low-pass filter, an audio amplifier, and a speaker all connected in sequence in the order named. These devices are each well known in this art and many different forms of each exist and are available. Any appropriate type of these devices respectively may be selected and when connected as shown and described will provide a suitable pick-up curcuit for use with this invention as will be readily apparent to one skilled in this art.

It should be further understood that the electrical signal delivered by the performers body to the electrode 17 consists of the desired signals from the counters and gates 15 as well as unwanted hum and electrical noise signals which are in the audio frequency range. The pulses passing from the counters and gates 15 consist of both radio frequency and audio frequency Fourier components. As shown in FIG. 1 these signals are fed to the input of the high-pass filter of the pick-up circuit 16 where substantially all of the audio frequency signals, including the hum and noise signals are removed. The radio frequency Fourier components are then amplified as shown and passed to the detector. Inasmuch as the output of the detector consists of both radio frequency and audio frequency signals the low-pass filter is provided and serves to remove the radio frequency signals. The resulting audio frequency signal is then amplified and passed to the speaker.

Figure 3:
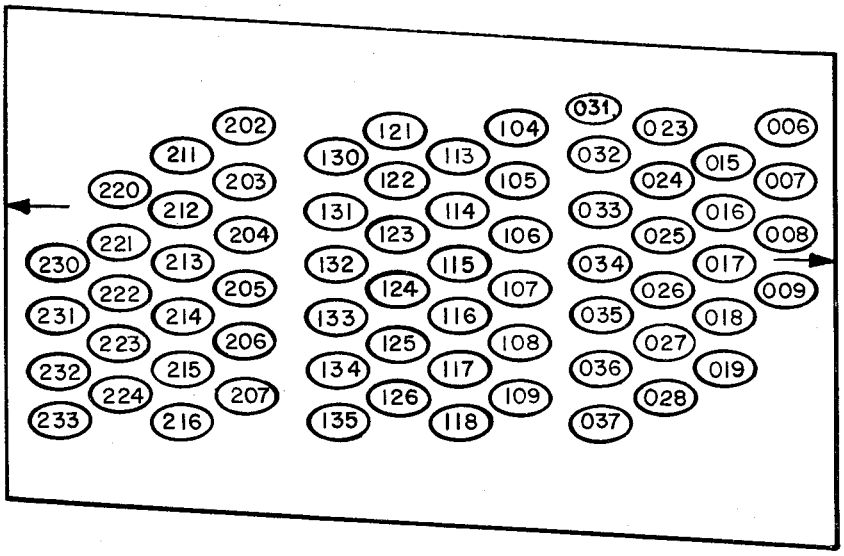
FIG. 3 is a view shown as a layout illustrating, in a single plane, the surface of the keycylinder and the disposition of the contact points respectively thereon and particularly there aligned disposition on helices. To indicate the positions of the respective contact points on a cylindrical surface the single plane representation of this FIGURE should be considered as having been rolled to form a cylinder with the right and left edges of the representation coming together in such manner that the two arrows shown on the respective edges are aligned. When so formed the slanting upper and lower edges of the representation of this figure will be formed to lie on true circles.

When the invention is used to produce rhythm, the capacitor 14 is connected. Then each contact point gives a metronomelike series of clicks whose tone can be adjusted to sound like a drum. The tempo of the clicks can be changed by rotating the cylinder or the potentiometer knob. Several related rythms such as double time, triplets, etc., are available at once and can be instantly elicited by touching the appropriate contact points. When the cylinder is rotated, the tempos change in perfect synchronization. Figure 3 illustrates one preferred pattern of contacts on the surface of the keycylinder. Each oval or contact there shown marked with three digits is electrically connected to the correspondingly marked oval or contact shown of FIG. 2.

The particular arrangement of the contact points on a plurality of helices on the surface of the cylinder is highly advantageous from the standpoint of the ease and quality of performance, as will be understood from the following considerations that have dictated the construction and arrangement of the cylinder employed with this invention in place of a keyboard.

The primary objective is to provide closeness of the contact points that make consonances. Starting with a pitch (or contact point) A, it is desirable to put the octave contact point close to it. Thusly:

| |
|---|
| B |
| A |

when contact B is an octave above A. But as A is an octabe above some other note C, we get:

| |
|---|
| B |
| A |
| C |

where A is an octave above C. Continuing in this manner, we get all the octaves of a pitch in a line. For example, if one of them is 440Hz, we will get:

| | |
|---|---|
| 1760 | a''' |
| 880 | a'' |
| 440 | a' |
| 220 | a |
| 110 | A |
| 55 | AA |

Thus, we get the contact points for all the octaves of a pitch in lines.

The other lines must be parallel to the first line. Again, it is desirable to have the closest contact to be those which are next to the most perfect consonance.

The next best consonance is the fifth, so the line of octaves related by a fifth are put next to the first line of contact points, whether to the left or right is of no consequence, so here they may be arbitrarily placed on the right. Next, it is noted that 12 consecutive fifths equal 7 consecutive octaves exactly with equal temperament fifths or approximately with justly intoned fifths.

If a pattern is followed that puts the 12th consecutive fifth in the same place as the 7th consecutive octave of a contact point, the set of parallel lines must be rolled into a cylinder. Then the consecutive fifths lie on helices and all the other helices are formed at the same time. This arrangement has a great deal of symmetry.

It is well known to musicians that in the scale known as the justly intoned scale, not all fifths are justly intoned. In view of this, when the cylinder of this invention is used on justly intoned instruments, a slightly greater space is provided between the two contact points which generate a nonjustly intoned fifth. This enables the performer to first recognize which of the fifths are of this type and helps the performer avoid unwanted contact with such points. However, the space is not so large as to prevent common contact with a finger or thumb of such points when it is desired to do so. Although the cylinder of this invention is particularly adapted for use on justly intoned instruments, it should be understood that such cylinders can be used on instruments other than those that are justly intoned.

Figure 2:
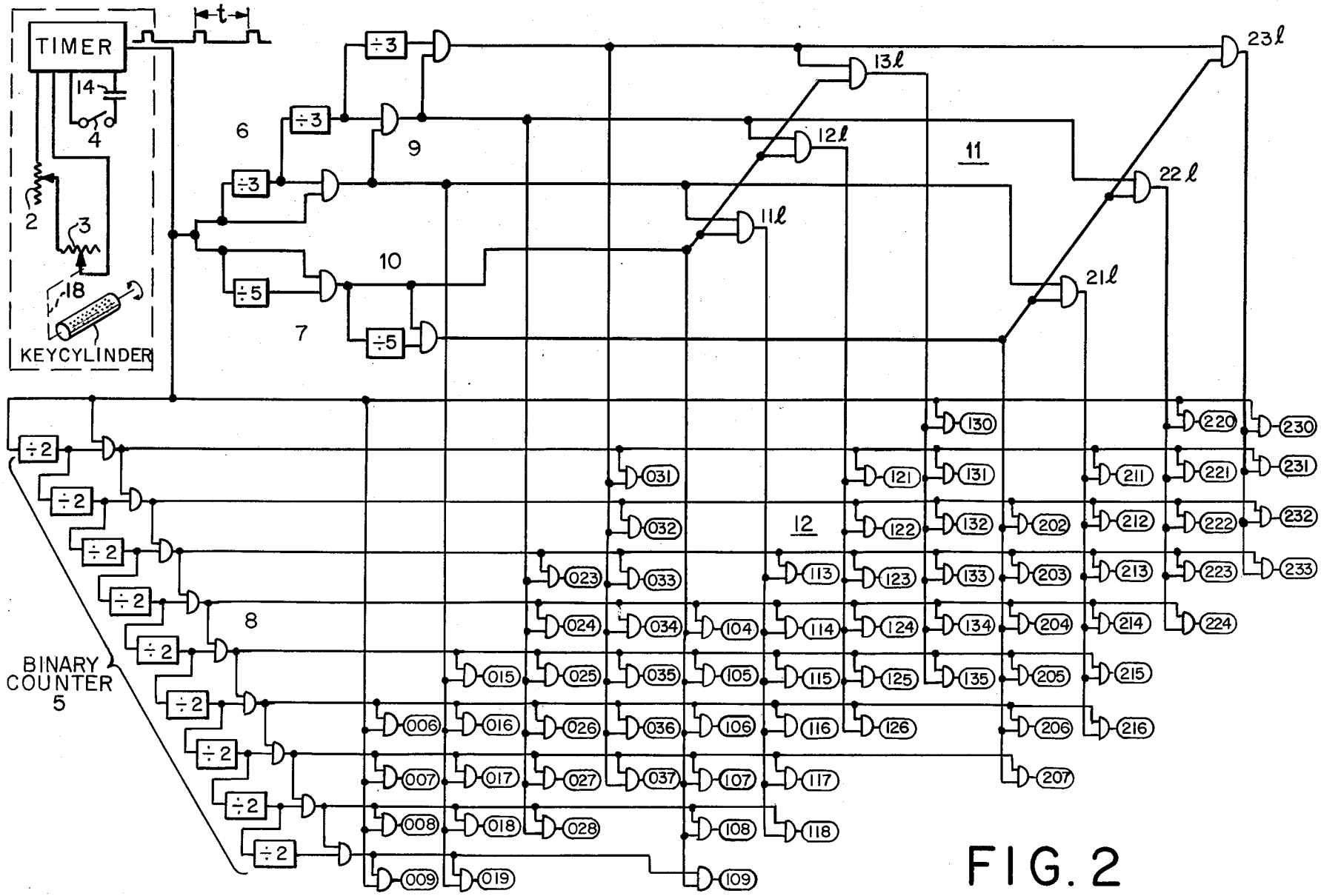
FIG. 2 is a combined block and logic diagram illustrating specifically the counter and gates employed, the wiring therefor and a logic diagram for keycylinder helix represented in FIG. 1.

In operation, the timer 1 generates a series of pulses $P_o$ having an adjustable source interval of time t between positive pulse transitions. The interval duration may be adjusted by changing the resistance of one of two potentiometers. The potentiometer 3 shown in FIGS. 1 and 2 is coupled mechanically to the keycylinder so that a rotation of the keycylinder about its axis or other intended movement of the keycylinder causes a corresponding movement of the potentiometer shaft.

The pulses $P_o$ are applied in parallel to three series of digital counters which individually generate output pulses having interval durations between respective output pulses which are in predetermined relationship to the source interval t between source pulses $P_o$. Specifically, each respective interval generated by the digital counters is a multiple integral of the source interval t.

The first series of counters 5 includes divide-by-two counters which effectively generate pulses having intervals which are 2, 4, 8, . . . $2^n$ times the source interval t. The series of two's counters includes two's counters having respective outputs serially connected. Thus, each two's counter generates output pulses having intervals which are twice as long in duration as the intervals between output pulses of the immediately preceding two's counter. Dual input AND-gates 8, are provided at the output of each two's counter and each gate accepts the output of its corresponding two's counter, as well as the output of the immediately preceding two's counter. The first counter in the series has its output coupled to an AND-gate which has its other input coupled to the output of the timer 1. Thus, since each AND-gate has one input coupled to the output of the previous gate and the first AND-gate accepts the timer output as an input, each of the AND-gate outputs generates pulses of the same duration as the output pulses from the timer. Each AND-gate generates an output of a series of fixed duration pulses with a predetermined interval between pulses, which interval is $2^n$ times the source interval t, wherein $n=1, 2, \ldots$ and corresponds to the position of the respective two's counter in the series. Moreover, each AND-gate output pulse is coincident with an output pulse from the timer, although the AND-gate pulses occur less frequently than the timer output pulses.

Figure 4:
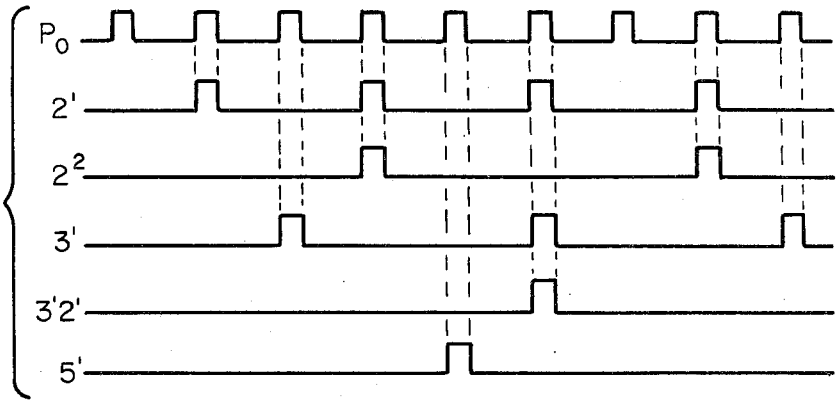
FIG. 4 is a timing diagram for the instrument.

The timing relationship between the timer output pulses and the output pulses of the first two AND-gates (which are coupled to the first two two's counters) is shown in the FIG. 4.

The series of three's counters 6 and the associated AND-gates 9, function in a manner similar to the above-described two's counters and associated AND-gates. Specifically, the output pulses generated by the AND-gates 9 are of the same duration as the source pulses generated by the timer 1. The intervals between the respective AND-gate output pulses is $3^n$, $n=1, 2, 3$; and each AND-gate output pulse is coincident with a source pulse generated by the timer 1.

The timing relationship between the timer output pulses and the output pulses of the AND-gate coupled to the first threes counter is shown in FIG. 4.

The series of five's counters 7, and the associated AND-gates 10, function in a manner similar to the foregoing described two's and three's counters with associated AND-gates. A five's counter will generate an output pulse after the initiation of every fifth pulse. Therefore, the output pulses of the AND-gate coupled to the source timer 1 and the first five's counter generates a series of pulses having between-pulse intervals equal to five times the source pulse interval t. The second AND-gate generates a series of pulses having between-pulse intervals equal to twenty-five times the source pulse interval t. That is, the AND-gate pulses have between-pulse intervals of $5^n$ ($n=1, 2$) times the source pulse interval t, where the value $n$ corresponds to the position in the series of the five's counter and the associated AND-gate. Each output pulse generated by the AND-gate 10 is of the same duration as each timer pulse and is coincident with one of the timer pulses.

Briefly, the outputs of the AND-gate groups 8, 9 and 10, are a series of pulses having between-pulse intervals which are in predetermined integral relationship with the timer output pulse t. Moreover, each AND-gate pulse is always of the same duration as a timer pulse and is always coincident with a timer pulse. Specifically, the intervals between AND-gate pulses are $2^n$, $3^n$, and $5^n$ times the source pulse interval t.

Several dual input AND-gates 11 have their inputs coupled to various outputs of the AND-gates associated with the three's and five's counters. The AND-gates 11 will produce output pulses only when both respective inputs receive coincident pulses from the counter-associated AND-gates. Thus, the intervals between the output pulses generated by the AND-gates 11 are 53 $3^k$ t, $h=1, 2$; $k=1, 2, 3$; where h and k indicate the relative positions of the counter associated with the AND-gate which provides an input for one of the AND-gates in group 11. Since the inputs to the AND-gates 11 are coincident and of the same duration, the outputs of the AND-gates 11 are of the same duration as the pulses from the timer 1.

The AND-gates coupled to the AND-gates associated with the two's counters function similarly. Thus, the AND-gates identified with the reference letters "hkl" produce a series of pulses which have between-pulse intervals equal to $5^h3^k2^l$ t, where h, k, and l indicate the relative positions of the counter associated with the AND-gate which provides an input to one of the AND-gates having identifying numbers "hkl" or one of the prior AND-gates in the group designated by the reference numeral 11.

The output pulses of the AND-gates having their outputs labelled "hkl" are utilized by the operator's finger touching the contacts of the helix of contacts on the keycylinder coupled to the outputs of these AND-gates.

I claim:

1. An electronic musical instrument which produces justly intoned pitches and is capable of changing at will during performance the basis pitch or key signature being played, comprising, means for producing a train of electrical pulses, means for selectively varying at the will of the operator the interval between said pulses, means for converting said train of pulses to a number of pulse trains which are related in frequency by ratios of small integers to produce justly intoned intervals and which ratios are maintained unchanged regardless of the frequencies of said pulse trains, a speaker, a systems of circuits for energizing said speaker which includes a multiplicity of conductive contacts each of which is connected respectively to the corresponding one of the pulse trains of said number of pulse trains, the circuits including each respectively of said multiplicity of conductive contacts being adapted to be selectively closed by the operator whereby the operator by closing selected ones of said conductive contacts and selectively varying the interval between the pulses of said train of pulses may control the resulting sound produced by the speaker.

2. The musical instrument defined in claim 1 further characterized in that the instrument includes a keycylinder which has mounted on its surface said multiplicity of conductive contacts and which is of a size to be accommodated in the hands of the operator with said conductive contacts readily accessible to the fingers and thumbs of the operator.

3. The musical instrument defined in claim 1 further characterized in that the conductive contacts are disposed so as to form a plurality of helices.

4. The musical instrument defined in claim 3 further characterized in that helices of contacts are so disposed that a plurality of contacts may be touched at one time by a single finger or a thumb of the operator.

5. The musical instrument defined in claim 4 further characterized in that the contacts which have the capability of being simultaneously touched by a single finger or a thumb are connected to produce consonant sounds.

6. The musical instrument defined in claim 1 further characterized in that said keycylinder is capable of movement and is connected to said means for selectively varying at will the interval between pulses, so that by movement of said keycylinder the basis pitch or key signature will be changed during performance on the instrument according to the will of the operator.

7. The musical instrument defined in claim 1 further characterized in that a means is included for producing one or a plurality of related rhythms by causing each contact point to give a metronome-like series of clicks the tones of which can be adjusted to sound like a drum and the tempo of which can be changed during performance according to the will of the performer.

8. An electronic musical instrument which produces justly intoned pitches and is capable of changing at will during performance the basis pitch or key signature being played, comprising, means for producing a train of electrical pulses, means for selectively varying at will the interval between said pulses, means for converting said train of pulses to a number of pulse trains which are related in frequency by ratios of small integers to produce justly intoned intervals and which ratios are maintained unchanged regardless of the frequencies of said pulse trains, a speaker, a system of circuits for energizing said speaker which includes a multiplicity of conductive contacts each of which is connected respectively to the corresponding one of the pulse trains of said number of pulse trains and the body of the operator, the interval between the pules of said train of pulses being capable of being varied at will by the operator, said multiplicity of conductive contracts being adapted to be selectively touched by the operator whereby the pressure of the operator's fingers touching said contacts will effectively control the loudness of softness of the resulting sound produced by the speaker and the bodily movement by the operator of said multiplicity of contacts will change the key signature being played.

9. The musical instrument defined in clain 8 further characterized in that the instrument includes a keycylinder which has mounted on its surface said multiplicity of conductive contacts and which is of a size to be accommodated in the hands of the operator with said conductive contacts readily accessible to the fingers and thumbs of the operator.

10. The musical instrument defined in claim 9 further characterized in that the conductive contacts on said keycylinder are disposed so as to form a plurality of helices.

11. The musical instrument defined in claim 10 further characterized in that helices of contacts are so disposed that a plurality of contacts may be touched at one time by a single finger or a thumb of the operator.

12. The musical instrument defined in claim 11 further characterized in that the contacts which have the capability of being simultaneously touched by a single finger or a thumb are connected to produce consonant sounds.

13. The musical instrument defined in claim 9 further characterized in that said keycylinder is capable of movement and is connected to said means for selectively varying at will the interval between pulses, so that by movement of said keycylinder the basis pitch or key signature will be changed during performance on the instrument according to the will of the operator.

14. The musical instrument defined in claim 9 further characterized in that a means is included for producing one or a plurality of related rhythms by causing each contact point to give a metromone-like series of clicks the tones of which can be adjusted to sound like a drum and the tempo of which can be changed during performance according to the will of the performer.

* * * * *

UNITED STATES PATENT AND TRADEMARK OFFICE

CERTIFICATE OF CORRECTION

PATENT NO. : 4,241,636

DATED : December 30, 1980

INVENTOR(S) : Christopher Long

It is certified that error appears in the above–identified patent and that said Letters Patent are hereby corrected as shown below:

In the Abstract, line 11 of the right-hand column, delete "derin" and insert therefor --der in--.

In column 1, line 38, delete "Pythagorus" and insert therefor --Pythagoras--.

In column 3, lines 65-67, all five occurrences of "1" should be --l-- (the letter L).

In column 4, line 55, delete "curcuit" and insert therefor --circuit--.

In column 5, line 30, delete "metronomelike" and insert therefor --metronome-like--.

In column 5, line 59, delete "octabe" and insert therefor --octave--.

In column 6, line 43, "interval" should be in italics.

In column 7, line 34, delete "threes" and insert therefor --three's--.

In column 7, line 67, delete "53 3k" and insert therefor --5h3k--.

UNITED STATES PATENT AND TRADEMARK OFFICE

CERTIFICATE OF CORRECTION

PATENT NO. : 4,241,636

DATED : December 30, 1980

INVENTOR(S) : Christopher Long

It is certified that error appears in the above-identified patent and that said Letters Patent are hereby corrected as shown below:

In column 7, line 68, at the second occurrence, "h" and "k" should be in italics, In column 8, line 11, "h", "k" and "l" should be in italics.

In column 10, line 31, delete "metromone-like" and insert therefor --metronome-like--.

Signed and Sealed this

*Twenty-third* Day of *June 1981*

[SEAL]

*Attest:*

RENE D. TEGTMEYER

*Attesting Officer*

*Acting Commissioner of Patents and Trademarks*